United States Patent [19]

Tarrant

[11] Patent Number: 4,656,767

[45] Date of Patent: Apr. 14, 1987

[54] CABLE TAG

[76] Inventor: Thomas G. Tarrant, P.O. Box 199, Hunt, Tex. 78024

[21] Appl. No.: 830,264

[22] Filed: Feb. 18, 1986

[51] Int. Cl.[4] ..... G09F 3/00

[52] U.S. Cl. ..... 40/316; 174/112

[58] Field of Search ..... 40/316, 317, 322, 21 A, 40/23 R, 2 R, 908, 344; 174/112

[56] References Cited

U.S. PATENT DOCUMENTS 2,514,437 7/1950 Bailhe ..... 40/316
4,004,362 1/1977 Barbieri ..... 40/316

FOREIGN PATENT DOCUMENTS 674239 11/1963 Canada ..... 40/316
744964 10/1966 Canada ..... 40/2 R
655749 1/1938 Fed. Rep. of Germany ..... 40/316
13296 of 1909 United Kingdom ..... 40/23 R

*Primary Examiner*—Robert Peshock
*Assistant Examiner*—Cary E. Stone
*Attorney, Agent, or Firm*—Harvey B. Jacobson

[57] ABSTRACT

An elongated plastic strip is provided including first and second sides and including longitudinally spaced "Velcro" hook and loop panels mounted on the first side at points spaced longitudinally along the strip. The strip may be laterally deflected about a cable to be identified and the spacing between the panels is slightly less than the circumference of the cable about which the strip is to be laterally deflected. One end portion of the second side of the strip includes identifying indicia facing outwardly thereof.

7 Claims, 5 Drawing Figures

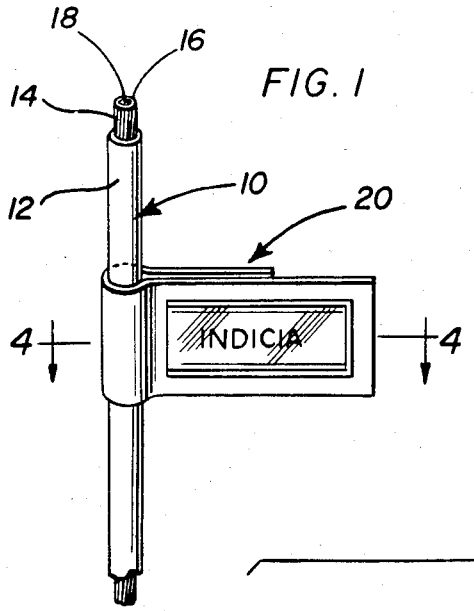
FIG. 1
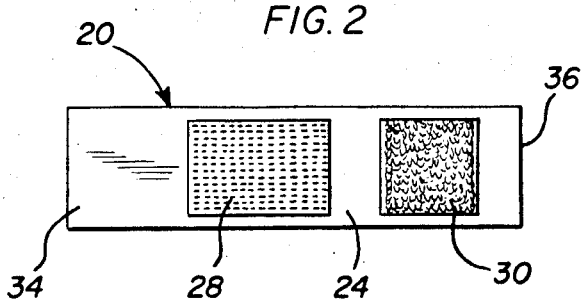
FIG. 2
FIG. 3
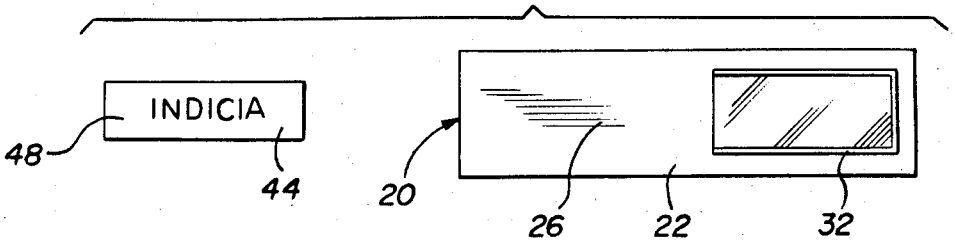
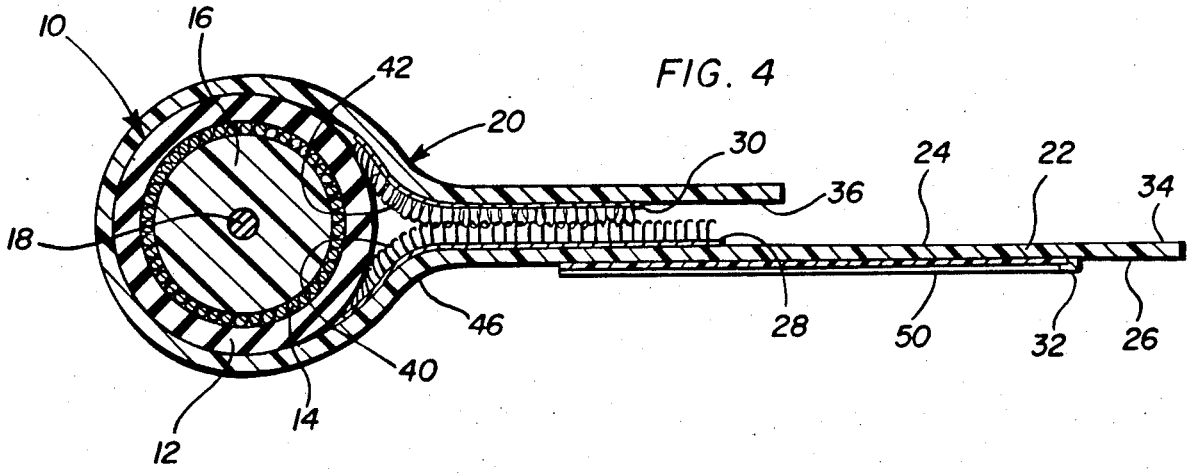
FIG. 4
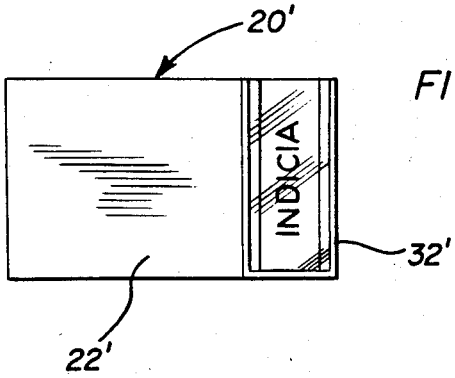
FIG. 5

CABLE TAG

BACKGROUND OF THE INVENTION

1. Field of the Invention

This invention relates to an elongated strip having identifying indicia thereon and laterally deflectable about and tightly securable upon a cable mid-length portion for identifying that cable.

2. Description of Related Art

Various different forms of strips and bands including identifying and/or or other indicia thereon heretofore have been provided for securement about and/or support from a midportion of an elongated member. Examples of previously known devices of this type are disclosed in U.S. Pat. Nos. 3,088,237, 3,218,748, 3,352,040, 3,586,220 and 4,091,766. However, these previously known devices are not specifically designed for use in identifying elongated cables and, accordingly, do not include the simplified structure of the instant invention capable of attaching an identifying tag to the insulation disposed about an electrical cable or wire in a manner such that the identifying tag will be maintained stationary on the cable, independent of vertical or horizontal orientaton of the cable and/or vibration of the cable.

SUMMARY OF THE INVENTION

The cable tag of the instant invention comprises an elongated flexible strip having identifying indicia supported from one end thereof and including longitudinally spaced coacting "hook" and "loop" thistle-type fastener panels mounted thereon and releasably engageable with each other upon disposition of the strip about the exterior of a cable to be identified. The spacing between the aforementioned panels is less than the circumference of the cable insulation, whereby a portion of the loops and hooks of the panels will be deflected by securement of the strip about the cable insulation and thus tightly frictionally grip the insulation to maintain the strip in position upon the cable against shifting of its position thereon.

The identifying indicia carried by the strip appears on an identification label strip which is telescoped into a pocket defined on the side of the first mentioned strip remote from the hook and loop panels supported therefrom. In addition, the pocket is supported from one end of the strip and opens toward the other end thereof on at least one form of the invention.

The main object of this invention is to provide an apparatus by which the identity of a cable may be indicated thereon by an identification tag disposed about and supported from a mid-length portion of the cable.

Another object of this invention is to provide an identification tag for insulated electrical cables and the like which may be applied to selected cables in a manner to prevent shifting in position of the tag on the cable.

Still another important object of this invention is to provide a cable identification tag in accordance with the preceding objects and which may be utilized on cables of different diameters.

Another object of this invention is to provide a cable identification tag which may be firmly attached to a cable to be identified, but which may be readily removed and reattached to another cable, if the situation demands.

A final object of this invention to be specifically enumerated herein is to provide a cable identification tag in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of a cable section about which a cable tag constructed in accordance with the present invention has been removably secured;

FIG. 2 is a plan view of the cable opposing side of the tag;

FIG. 3 is a plan view of the side of the cable tag which faces outwardly of an associated cable and with an identification strip in exploded position relative to the tag;

FIG. 4 is an enlarged sectional view taken substantially upon the plane indicated by the section line 4—4 of FIG. 1; and FIG. 5 is a plan view of a modified form of cable identification tag.

DESCRIPTION OF THE PREFERRED EMBODIMENTS

Referring now more specifically to the drawings, the numeral 10 generally designates a section of cable including an outer insulation layer 12, a woven shielding layer 14, an inner insulation layer 16 and a central conductor 18.

The numeral 20 generally designates an identification tag including an elongated strip 22 of flexible material such as plastic. The strip 22 includes a first side 24 and a second side 26. The first side 24 has "hook" and "loop" thistle-type fastener panels 28 and 30, respectively, secured thereto at points spaced longitudinally along the strip 22 and the second side 26 of the strip 22 includes an open ended elongated flexible envelope 32 secured thereto adjacent one end 34 of the strip 22 and opening toward the other end 36 of the strip 22.

The tag 20 is designed to be laterally deflected about and mounted upon a cable such as the cable 10 wherein the circumference of the cable is greater than the spacing between the pads 28 and 30, see FIG. 4. In this manner, when the pads 28 and 30 are tightly pressed together, portions of the hooks 40 of the pad 28 and portions of the loops 42 of the pad 30 are laterally deflected. These deflected hooks and loops 40 and 42 tightly frictionally engage the insulation 12 and also serve to increase the tension of that portion of the strip 28 disposed between the pads 28 and 30 and engaged directly with the insulation 12. Accordingly, the tag 20 frictionally grips the insulation 12 in a manner not only preventing rotation of the tag 20 about the insulation 12 but also shifting of the tag 20 longitudinally of the cable 10. The envelope 32 slidingly receives an identification slip 44 therein and the curving of the strip 22 at 46, see FIG. 4, prevents full accidental longitudinal displacement of the slip 44 from the envelope 32.

The slip 44 has indicia 48 thereon which may be printed on the slip 44 at the time the tag 20 is secured about the cable 10, or the indicia 48 may be preprinted.

In addition, the slip 44 may have preprinted indicia 48 on one side thereof and be blank on the other side thereof. In this manner, either the preprinted indicia 48 may face outwardly through the transparent outer side 50 of the envelope 32 or indicia may be printed upon the blank side of the slip 44 and face outwardly through the transparent side 50 of the envelope 32.

With attention invited more specifically to FIG. 5, a modified form of tag is referred to in general by the reference numeral 20' and comprises a strip 22' which is wider than the strip 22 and includes a transversely arranged envelope 32' on one end thereof. Otherwise, the tag 20' is substantially identical to the tag 20 and the side thereof opposite the envelope 32' includes pads (not shown) corresponding to the pads 28 and 30 and spaced apart along the strip 22'.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cable tag for placing identification upon an otherwise unidentified cable, said tag including an elongated strip of flexible material having first and second sides, said first side of said strip including longitudinally spaced "hook" and "loop" thistle-type fastener panels mounted thereon with said fastener panels spaced apart along said strip a distance less than the circumference of said cable, said second side of said strip, on one end thereof, including identifying indicia, said strip being tightly deflectable about said cable with the portion of said first side spaced between said panels tightly contacting a major portion of the circumference of said cable and said panels tightly anchored relative to each other, portions of the hooks on said "hook" panel adjacent the "loop" panel being yieldingly deflected by said cable and enjoying a frictional grip on the cable and further functioning to increase the tension of the portion of said strip disposed between said panels and the frictional grip of that portion on the cable.

2. The tag of claim 1 wherein said identifying indicia is removably mounted from said one end of said strip.

3. The tag of claim 2 wherein said second side of said one end of said strip includes means defining a pocket thereon opening lengthwise along said strip towards said second end thereof, said identifying indicia being carried by an identification slip telescoped into said pocket.

4. The tag of claim 3 wherein said means defining a pocket on said strip includes an envelope including one marginal portion mounted on said second side of said strip.

5. The tag of claim 4 wherein said envelope is constructed of plastic.

6. The tag of claim 2 wherein said second side of said one end of said strip includes means defining a pocket thereon opening laterally outwardly of one longitudinal side edge of said strip.

7. The tag of claim 1 wherein said strip is constructed of plastic.

* * * * *